United States Patent [19]

Roman et al.

[11] Patent Number: 5,030,994

[45] Date of Patent: Jul. 9, 1991

[54] ELECTROPHOTOGRAPHIC APPARATUS WITH MULTIPLE SPEED MODE

[75] Inventors: Ronald T. Roman; Hitoshi Dekura, both of Mission Viejo, Calif.

[73] Assignee: Toshiba America Information Systems, Inc., Irvine, Calif.

[21] Appl. No.: 437,940

[22] Filed: Nov. 16, 1989

[51] Int. Cl.[5] ..... G03G 15/28

[52] U.S. Cl. ..... 355/235; 355/233

[58] Field of Search ..... 355/233, 235, 243, 232

[56] References Cited

U.S. PATENT DOCUMENTS

| | | | |
|---|---|---|---|
| 4,101,218 | 7/1978 | 8Saruwatari | 355/235 X |
| 4,411,514 | 10/1983 | Komori et al. | 355/14 |
| 4,537,495 | 8/1985 | Kopko | 355/246 X |
| 4,601,568 | 7/1986 | Takano et al. | 355/233 |
| 4,659,209 | 4/1987 | Yamada | 355/243 |

FOREIGN PATENT DOCUMENTS

| | | | |
|---|---|---|---|
| 0056471 | 3/1989 | Japan | 355/233 |

OTHER PUBLICATIONS

McGraw-Hill Encyclopedia of Science & Technology, vol. 13, pp. 373—375 (6th ed. 1989).

*Primary Examiner*—A. T. Grimley
*Assistant Examiner*—Thu Dang
*Attorney, Agent, or Firm*—Limbach, Limbach & Sutton

[57] ABSTRACT

An electrophotographic copying apparatus having an electromechanical optical scanner, optical reflecting and focusing assembly, photosensitive latent electrostatic imaging assembly, electrostatic charge generator and applicator, and electrostatic toner applicator, wherein the scanner and photosensitive assembly have selectably variable operational speeds and the electrostatic charge and toner applicators have substantially constant application rates, and further wherein the speeds of the scanner and photosensitive assembly may be selectably varied to maximize copying rate while minimizing electrostatic charge generation and electrostatic toner consumption.

21 Claims, 4 Drawing Sheets

ELECTROPHOTOGRAPHIC APPARATUS WITH MULTIPLE SPEED MODE

BACKGROUND OF THE INVENTION

1. Field of the Invention

The present invention relates to an electrophotographic apparatus capable of optically scanning and duplicating an original document (e.g., "photocopier"). In particular, the present invention relates to an electrophotographic copying apparatus having substantially increased copying speed and copy output, with minimal increase in electrostatic toner consumption, and with minimal degradation in copy quality.

2. Description of the Prior Art

Electromechanical devices capable of electrophotographically duplicating printed documents, commonly known as "photocopiers," are well known in the art. Such a device comprises two basic functional assemblies: an image generator assembly and an image transfer assembly.

The image generator assembly typically consists of an electromechanical scanning assembly containing an electrical lamp and a mirror. This assembly scans the original document illuminating it with the electrical lamp. Light reflected from the original document, representative of the image thereon, is reflected via the mirror to the image transfer assembly. By scanning the full width and length of the original document, a full image of the document as contained in the reflected light is transmitted via the mirror to the image transfer assembly.

The image transfer assembly contains a cylindrical drum having a photosensitive outer surface which is electrostatically charged by an electrostatic generator. The reflected light containing the image information of the original document received from the image generator assembly is used to expose the outer surface of this photosensitive drum as it rotates. This causes a latent electrostatic image to form on the outer surface of the drum which corresponds to and is the negative of the original document image. Electrostatic toner particles are then applied to the electrostatically charged surface of the drum. Black image areas, i.e., areas of the electrostatic image corresponding to areas of the original document containing image information, attract and retain the electrostatic toner particles. White image areas, i.e., areas of the latent electrostatic image corresponding to areas of the original document containing no image information, do not attract and therefore do not retain any electrostatic toner particles.

The rotating electrostatically charged surface of the drum, now containing areas retaining electrostatic toner particles, is brought into physical contact with the surface of a sheet of paper moving with a linear velocity substantially equal to the tangential velocity of the rotating drum. Simultaneous with this contact, an electrostatic charge opposite in potential to that originally applied to the outer surface of the rotating drum is generated at and applied to the opposite surface of the paper. This opposite electrostatic charge attracts the electrostatic toner particles, drawing them away from the outer surface of the rotating drum into the surface of the paper.

The paper, now having electrostatic toner particles impressed thereon and forming an image duplicating that of the original document, then passes through a series of heated rollers. This heat and pressure from the rollers causes the electrostatic toner particles to permanently bond to the surface of the paper. Thus, a substantially identical copy of an original document is created.

More detailed description of this typical, well-known photocopying process may be found in Komori et al., U.S. Pat. No. 4,411,514 and McGraw-Hill Encyclopedia of Science and Technology, Vol. 13, pages 373–75 (6th ed., 1989).

Implicit in this basic photocopying process is the requirement that the tangential speed of the outer surface of the rotating photosensitive drum, and therefore its rotational speed, corresponds to the speed of the scanning assembly scanning the original document. With proper correspondence of these speeds, the electrostatic image formed on the photosensitive drum and therefore transferred to the paper will be a substantially true copy of the original document, i.e., 1:1 original-to-copy image correspondence in both dimensions.

Komori et al., U.S. Pat. No. 4,411,514 discloses a photocopying apparatus which provides for varying the rotational speed of the rotating photosensitive drum relative to the linear speed of the scanning assembly, thereby allowing magnified or reduced photocopies to be made. According to the teachings of Komori et al., as the rotational speed of the rotating photosensitive drum is increased or decreased, the quantities of electrostatic charge and electrostatic toner applications are increased or decreased proportionally, respectively. Thus, as the rotational speed of the rotating photosensitive drum varies, the copy image quality remains substantially consistent.

SUMMARY OF THE INVENTION

Current electrophotographic copying machines are designed to operate at a single copy rate and produce high quality copies. To maintain this high copy quality, substantial applications of electrostatic charge and toner are required. Thus, if the copy rate is increased, so must the applications of electrostatic charge and toner.

In today's workplaces and elsewhere, photocopies are often needed quickly and in large numbers. However, a large number of photocopies are only used once and then discarded. The copy quality is of minimal concern, needing only to be merely readable or recognizable. In such cases producing high quality copies is wasteful of the resources needed to produce the concomitant high level applications of electrostatic charge and toner. Therefore, a need exists for a photocopier which produces copies at an increased rate without a wasteful concomitant increase in applications of electrostatic charge and toner.

The present invention comprises a multiple speed electrophotographic copying machine. According to the present invention, the speeds of the scanning assembly and rotating photosensitive drum may both be selectively increased together so as to increase the copy rate, while maintaining the same copy scaling (e.g., 1:1 with no original-to-copy magnification/reduction). Furthermore, the speeds of the scanning assembly and rotating photosensitive drum may be selectively increased without a concomitant increase in applications of either the electrostatic charge or electrostatic toner.

The multiple speed electrophotographic copying machine of the present invention provides a user-operated speed selector whereby the user may select between a "standard" (high copy quality) and a "draft" (faster and poorer—but adequate—copy quality) mode of operation. In standard mode the scanning assembly and rotating photosensitive drum operate at their nominal design speeds with standard applications of electrostatic charge and toner, producing high quality copies. In draft mode the scanning assembly and rotating photosensitive drum operate at increased speeds but without increased applications of electrostatic charge and toner, producing faster and poorer, but adequate, quality copies.

The multiple speed electrophotographic copying machine of the present invention further provides a means by which the user may, while in draft mode, select the quality of the copies. While in draft mode, the user may selectively vary the copying speed (i.e., the speeds of the scanning assembly and rotating photosensitive drum) which, due to the constant application rates of electrostatic charge and toner, determines the resulting copy quality. Thus, the user may selectively maximize copy speed while minimizing wasteful applications of electrostatic charge and toner.

DETAILED DESCRIPTION OF THE INVENTION

Figure 1:
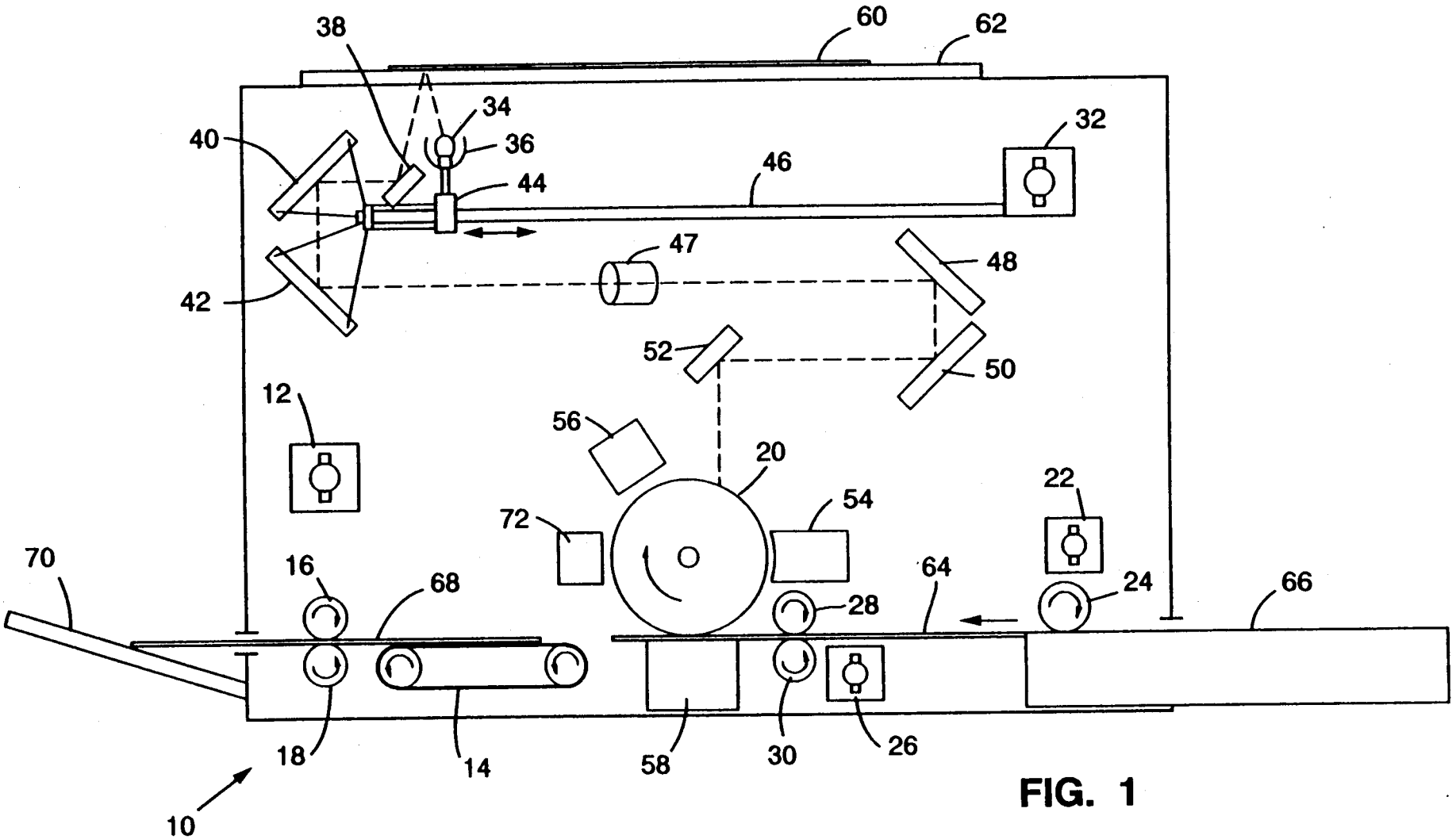
FIG. 1 is a simplified illustration of the main components used in the multiple speed electrophotographic copying machine of the present invention.

FIG. 1 illustrates the basic components used in an electrophotographic copying machine 10. These components include: a main motor 12 which drives the transport belt 14, fuser rollers 16, 18 and photosensitive drum 20; a feed motor 22 which drives a feed roller 24; an alignment motor 26 which drives alignment rollers 28, 30; a scanning motor 32 which drives a scanning lamp 34 and lamp reflector 36, a scanning mirror 38 and two scanning image reflectors 40, 42, all of which are mechanically coupled to a scanning transport 44 which is driven along a scanning guide 46; a lens unit 47, two fixed image reflectors 48, 50 and a fixed focusing mirror 52; an electrostatic toner applicator 54; an electrostatic generator 56; an electrostatic transfer charger 58; and a residual toner remover 72.

The scanning lamp 34, with the aid of its reflector 36, illuminates the face of an original document 60 lying on a glass panel 62 which serves as a support surface therefor. The illuminated image is reflected onto the scanning mirror 38 and image reflectors 40, 42 along their respective angles of incidence and reflection. The image then passes through the lens unit 47 and is reflected onto the fixed image reflectors 48, 50 and focusing mirror 52 along their respective angles of incidence and reflection. The focusing mirror 52 then focuses the reflected image onto the surface of the rotating photosensitive drum 20. As the scanning transport 44 carries the scanning components 34, 36, 38, 40, 42 along the scanning guide 46, scanning the length of the original document 60, the photosensitive drum 20 rotates with a tangential speed substantially equal to the linear speed of the scanning transport 44, for 1:1 copying (i.e., no magnification or reduction). Thus, the illuminated and reflected image of the document 60 is projected onto the outer surface of the photosensitive drum 20.

As the drum 20 rotates (in the direction of the arrow), positive electrostatic charges are applied thereto by the electrostatic generator 56 according to means well known in the art (e.g., an electrode having a high voltage applied thereto placed in close proximity to the electrically insulated surface of the drum 20). As the reflected image is focused onto the surface of the drum 20 by the focusing mirror 52, the positive electrostatic charges are erased in the areas where reflected image light is projected. Thus, areas on the drum 20 which correspond to white areas on the original document 60 retain virtually no electrostatic charge, while those areas corresponding to black areas on the original document 60 retain their positive electrostatic charge.

As the surface of the drum 20 rotates past the electrostatic toner applicator 54, toner is applied thereto. This toner, which is negatively charged, is attracted to and adheres to those areas of the outer surface of the rotating drum 20 which, corresponding to black areas on the original document 60, have retained their positive electrostatic charge.

A blank sheet of paper 64, withdrawn from a paper tray 66 by the feed roller 24, is aligned beneath the drum 20 by the alignment rollers 28, 30. The leading edge of this paper 64 is advanced so as to come into contact with the drum 20 at the point where the reflected image focused onto the drum 20 coincides with the leading edge of the original document 60.

The drum 20 continues to rotate, causing its toner laden surface to progressively come into contact with the blank paper 64. As the toner on the outer surface of the drum 20 is impressed upon the paper 64, a positive electrostatic charge is applied to the opposite side of the paper 64 by the transfer charger 58. This positive charge attracts substantially all of the negatively charged toner particles, causing them to become embedded in the top surface of the paper 64. Thus, the originally blank paper 64 becomes a photocopy 68 of the original document 60.

The emerging photocopy 68 is transported by the transport belt 14 to the fuser rollers 16, 18. The fuser rollers 16, 18 apply heat and pressure to the copy 68 which softens the toner particles and presses them into the paper's surface, bonding them thereto. The photocopy 68 is then ejected and placed into a receiving tray 70.

The drum 20 continues to rotate, its surface passing a residual toner remover 72. The residual toner remover 72 removes residual toner which was not attracted to and embedded in the surface of the paper 64, but instead remained on the surface of the drum 20. Such residual toner removers 72 are well known in the art and may comprise a plastic wiper blade or rotating soft fur brushes.

According to the present invention, the basic photocopy apparatus and process, as described above, remain the same. However, the electrophotographic copying machine of the present invention provides multiple copying speeds, e.g., "standard" and "draft" modes. As described more fully below, a user operated speed selector allows the photocopy machine user to select a draft mode, selectively accelerating the speed of the overall photocopying operation, without changing the copy scaling (e.g., 1:1 with no original-to-copy magnification/reduction). Although the reproduced image quality may become somewhat degraded, in many (if not most) cases it is adequate and the number of photocopies which may be produced per unit time may be easily and greatly increased.

Figure 2:
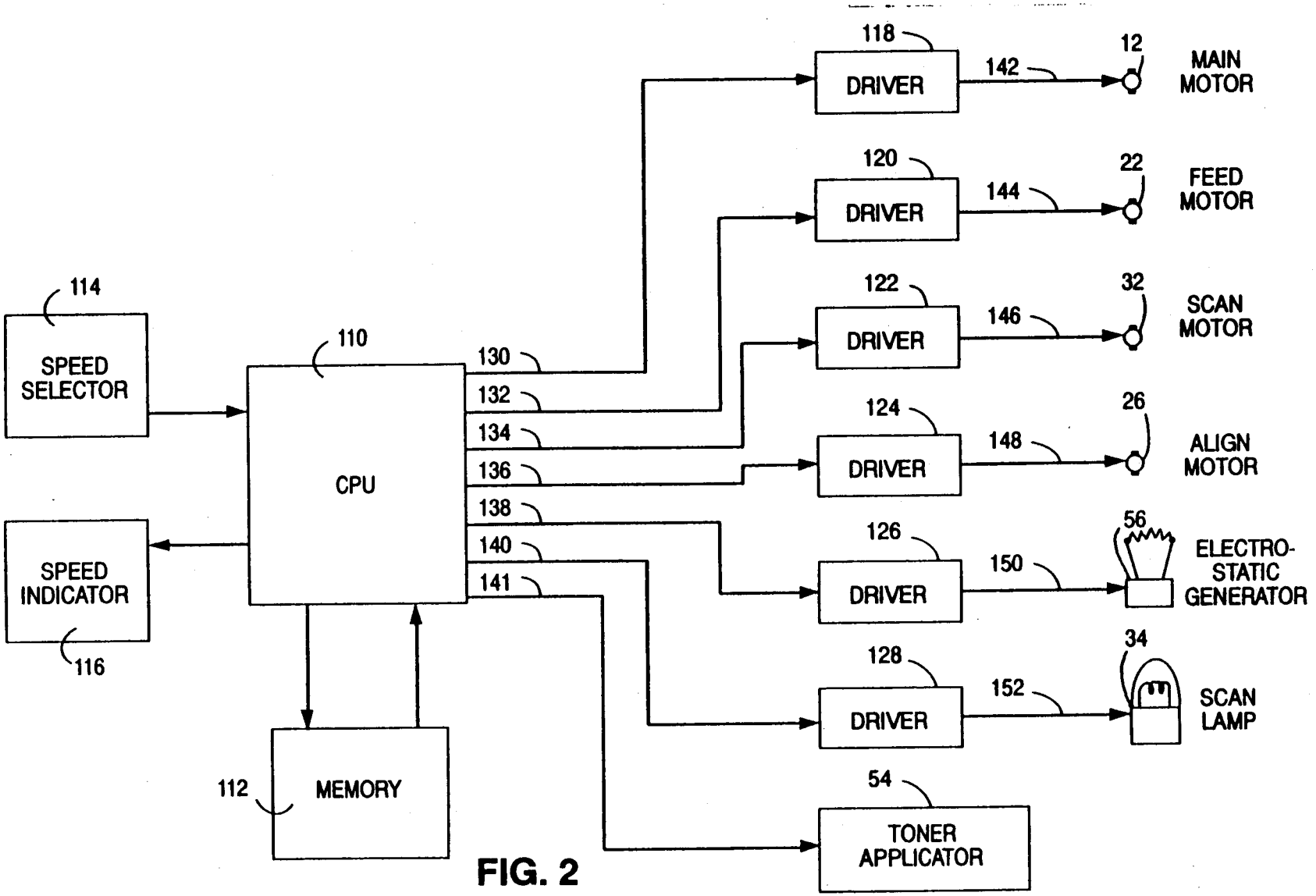
FIG. 2 is a simplified functional block diagram of the main components and electrical interconnections therebetween in the multiple speed electrophotographic copying machine of the present invention.

FIG. 2 illustrates in simplified, functional block diagram form the major electrical components and interconnections for the electrophotographic copying machine of the present invention. These major components include: a central processing unit ("CPU") 110; an electronic memory 112; a speed selector 114 (e.g., an electrical switch); a speed indicator 116 (e.g., an indicator lamp or light emitting diode); a main motor 12 and driver 118 therefor; a feed motor 22 and driver 120 therefor; a scanning motor 32 and driver 122 therefor; an alignment motor 26 and driver 124 therefor; an electrostatic generator 56 and driver 126 therefor; a scanning lamp 34 and driver 128 therefor; and a toner applicator 54.

The CPU 110 supplies the requisite control signals 130–141 necessary to operate the photocopying machine. The CPU 110 uses the electronic memory 112 for storing instructions and data necessary to its operation. According to the present invention, a speed selector 114 is available so that the user may selectively instruct the CPU 110 regarding the speed at which the photocopying machine is to be operated. A speed indicator 116 is also provided as a form of feedback to the user to indicate the speed at which the photocopying machine is being operated.

Depending upon the speed selected by the user or by the CPU 110 by default (e.g., standard or draft), the appropriate control signals 130–140 will be sent to the drivers 118–128 for the major components 12, 22, 32, 26, 56, 34 of the photocopying machine 10. Drivers for these types of components are well known in the art and are capable of accepting the digital control signals 130–140 from the CPU 110 and generating the appropriate signals 142–152 to directly drive their associated components.

Figure 3A:
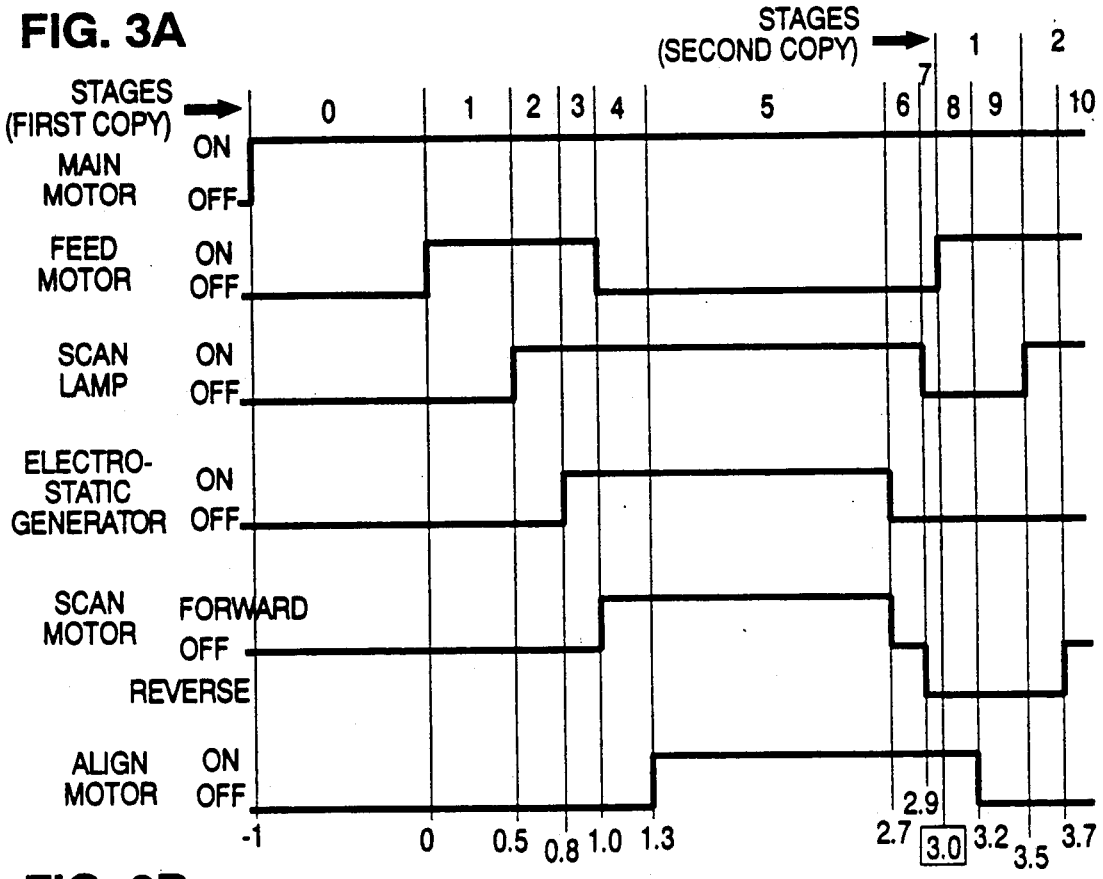
FIGS. 3A and 3B are timing diagrams showing the "on" and "off" states of the major components of a typical electrophotographic copying machine and the multiple speed electrophotographic copying machine of the present invention when operating at its accelerated speed, respectively.

FIG. 3A shows in timing diagram form the typical initial temporal status and sequence of the direct control signals 142–152 during standard operation at standard speed when copying first begins. Elapsed time in seconds from the beginning of Stage 1 is indicated along the bottom of FIG. 3A, while the numbers along the top indicate discrete "stages" of the photocopying operation for the first and second copies. Stage 0 is the 1-second time interval between when the user first instructs the photocopying machine 10 to begin and when the actual photocopying operation (as described above) begins.

During stage 0 the main motor is turned on, thereby activating the photosensitive drum 20, transport belt 14 and fuser rollers 16, 18. Thus, FIG. 3A illustrates with particularity the timing sequence of the photocopying operation which was described in general above for FIG. 1.

The feed motor 22 is on and feeding a sheet of paper 64 during stages 1–3. It is off during states 4–7, and turned back on at stage 8.

The scanning lamp 34 is turned on at stage 2 in preparation for illuminating and scanning the original document 60. It remains on until the end of stage 6, when scanning is complete.

The electrostatic generator 56 is turned on at stage 3, imparting its electrostatic charges to the photosensitive drum 20. It is turned off after stage 5 when scanning is complete.

The scanning motor 32 is turned on at stage 4, causing the scanning components 34, 36, 38, 40, 42 to scan the length of the document 60 in the forward direction. Scanning is complete after stage 5 and the scanning motor 32 is turned off. At stage 7, the scanning motor 32 is turned on in the reverse direction to return the scanning transport 44 to its original location. This reverse scanning is complete by stage 10 and the scanning motor 32 is turned off.

At stage 5 the alignment motor 26 is turned on for aligning the blank paper 64 with the rotating photosensitive drum 20. Alignment is complete and the alignment motor 26 is turned off after stage 8.

Figure 3B:
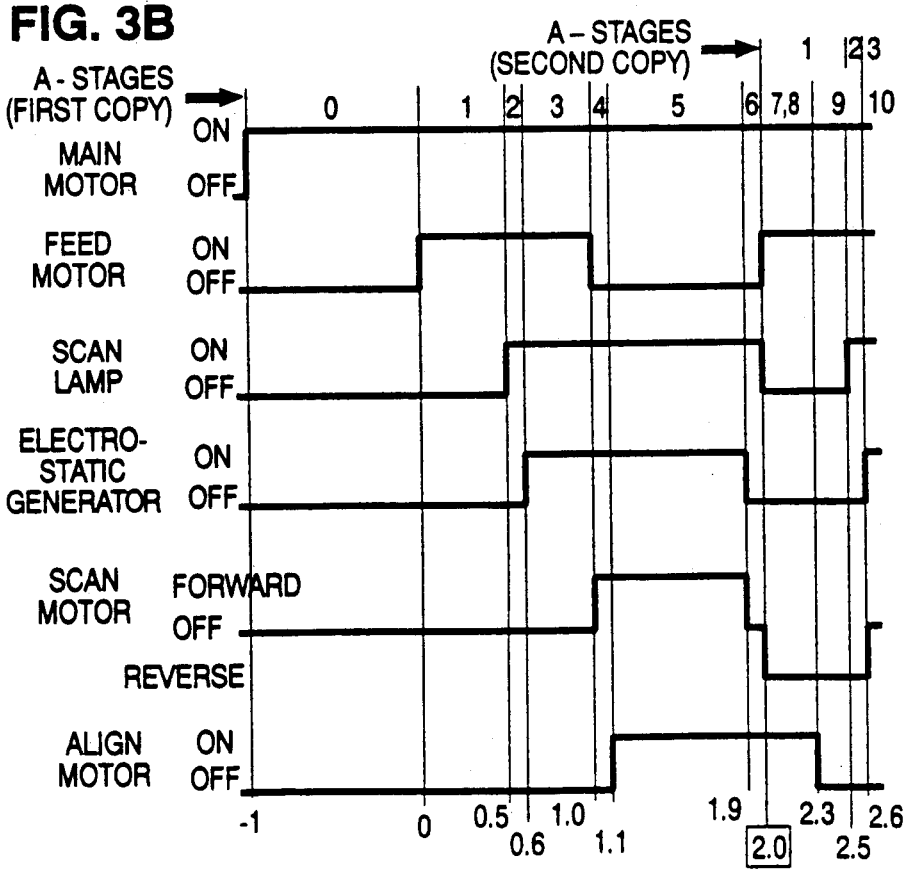

FIG. 3B illustrates the timing sequence for the control signals 142–152 for a preferred embodiment of the photocopy machine of the present invention operating at an accelerated copying speed (e.g., draft mode). The basic timing sequence is no different from that as shown in FIG. 3A and discussed above. However, although just as many stages ("A-stages" in this case) are involved, the time durations of several stages are reduced. In addition, the rate of application by the toner applicator 54 is not changed from that used in the standard mode (as described above for FIG. 3A).

For example, the "on" times for the scanning lamp 34, electrostatic generator 56, scanning motor 32 and alignment motor 26 are shorter. Although these "on" times are shorter, a full copying cycle is completed since the appropriate motors are operated at increased rates of speed. Furthermore, although the electrostatic generator 56 is on for a shorter period of time, the amount of charge per unit time applied by the generator 56 remains the same as in the standard mode. The main motor 12 runs faster so as to rotate the photosensitive drum 20 faster. The scanning motor 32 is run faster so as to move the scanning transport 44 faster. The alignment motor 26 is run faster so as to more quickly align the incoming blank paper 64 with the proper location on the outer surface of the rotating photosensitive drum 20.

Means by which these motors 12, 32, 26 may be operated at higher speeds are well known in the art. In a preferred embodiment of the present invention, the scanning motor 32 and alignment motor 26 are pulse motors. By controlling the width and/or number of voltage pulses applied to the motors, the speed of the motors is controlled. In a photocopy machine 10 under CPU control, as in the present invention, voltage pulses comprising the control signals 146, 148 to the scanning motor 32 and alignment motor 26 can be varied in width and/or frequency. This is quite easily accomplished by providing corresponding pulse variations in the control signals 134, 136 applied to the drivers 122, 124 responsible for driving the scanning motor 32 and alignment motor 26. In turn, such pulse variations may be provided for by storing the appropriate instructions and/or data within the electronic memory 112 for access and use by the CPU 110 when an accelerated speed has been selected by the user through the speed selector 114. Upon selection of an accelerated speed, the CPU 110 simply goes to the appropriate memory locations within the electronic memory 112 and uses the instructions and/or data stored therein to generate the appropriate control signals 134, 136.

Figure 4:
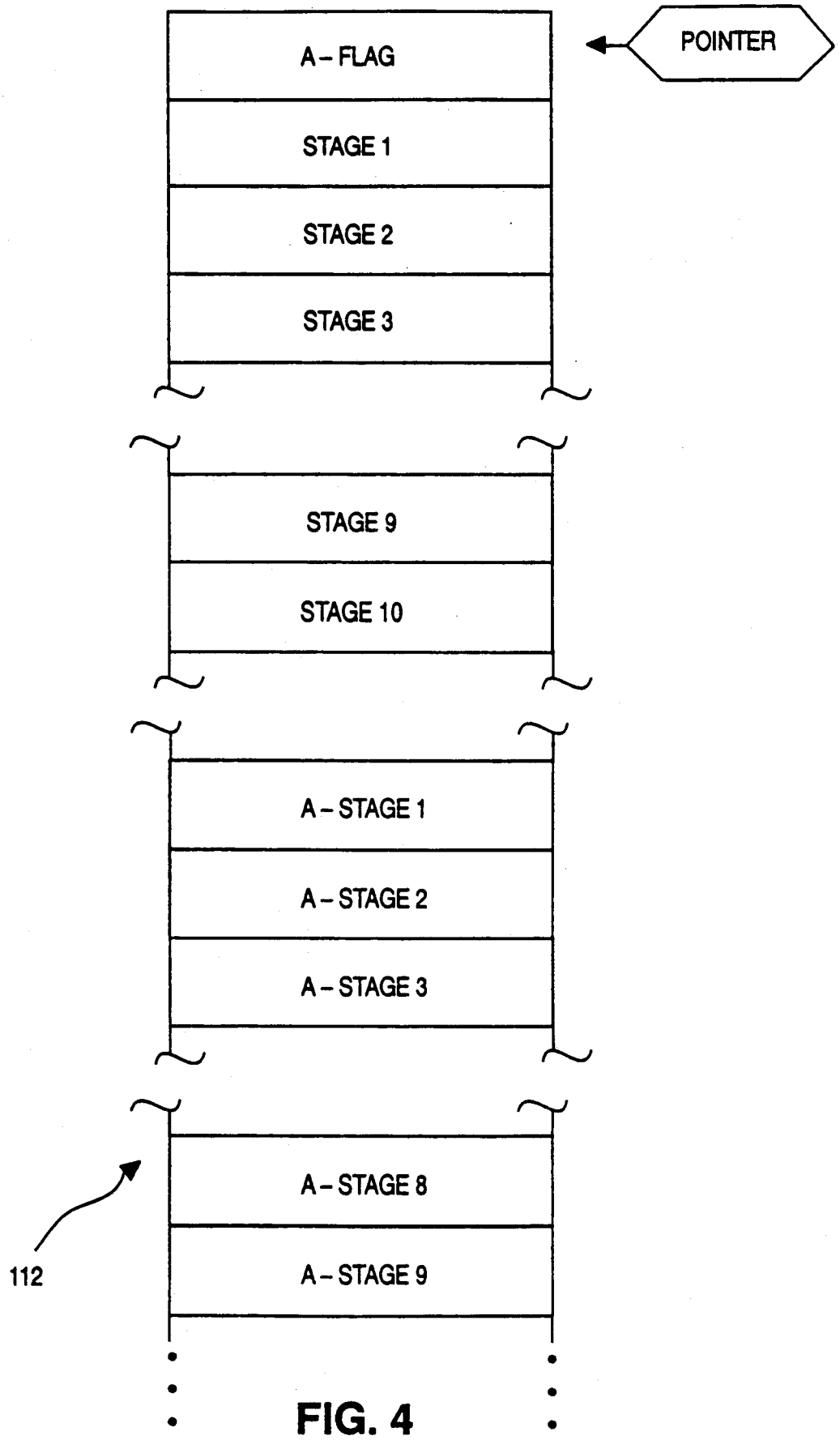
FIG. 4 illustrates pictorially the contents of the electronic memory used in the multiple speed electrophotographic copying machine of the present invention.

FIG. 4 illustrates how the electronic memory 112 may be organized to store instructions and/or data appropriate for use by the CPU 110 in controlling the various component drivers 118–128. Within the memory 112 the individual memory locations are used to store instructions and/or data necessary for the CPU 110 to generate the appropriate control signals 130–141 so as to operate the components 12, 22, 32, 26, 56, 34, 54 appropriately and in the proper timing sequences, as shown in FIGS. 3A and 3B.

For example, one memory location may be used to hold binary data representing a flag ("A-Flag") indicating that the accelerated speed mode has been selected by the user via the speed selector 114. Other memory locations may be used to store binary data representing the instructions and/or data needed by the CPU 110 to generate the appropriate control signals 130–141 during each stage of operation (see discussion above for FIG. 3A). Still other memory locations may be used to store binary data representing the instructions and/or data needed by the CPU 110 for generating the appropriate control signals 130–141 for each of the stages of operation in the accelerated speed mode (see discussion above regarding "A-Stages" for FIG. 3B). By proper movement of a memory pointer, shown in FIG. 4, according to the mode or speed selected, the appropriate memory location, and therefore the appropriate instructions and/or data, may be selected.

With regard to speed control for the main motor 122, a preferred embodiment of the present invention provides for the use of a main motor driver 128 capable of providing a drive signal 142 providing selectably variable voltage and/or current to the armature of the main motor 12.

In a variation of the apparatus 10 of the present invention, the speed selector 114 may be a switch by which the user may select between a standard mode having a single fixed reproduction speed and a plurality of draft modes, each having a different reproduction speed. The different draft modes differ in their rates of speeds of the main motor 12, scanning motor 32 and alignment motor 26. Each draft mode is selected by the user according to the desired reproduction speed. However, the application rates of the electrostatic generator 56 and toner applicator 54 remain substantially constant. Thus, the user may select the reproduction speed, but with an inverse effect on the level of reproduction quality.

In a preferred embodiment of the present invention the reproduction speed may be selected by the user via the speed selector 114 at the beginning of the reproduction operation, i.e., before any copies have been made. In an alternative preferred embodiment the reproduction speed may be selectively altered by the user via the speed selector 114 at any point in the reproduction operation.

Accordingly, by storing the appropriate binary instructions and/or data within the electronic memory 112 and selecting the appropriate drivers 118, 122, 124, the respective speeds of the main motor 12, scanning motor 32 and alignment motor 26 may be selectively increased when a higher photocopy rate is desired, without affecting the copy scaling. Hence, the photocopy rate may be maximized while minimizing wasteful electrostatic charge generation and electrostatic toner consumption.

What is claimed is:

1. An improvement in an electrophotographic apparatus capable of copying an original document in a copying operation, said apparatus comprising movable scanning means for scanning said original document at a scanning speed, movable photosensitive means for forming a latent electrostatic image at an imaging speed, electrostatic discharge means for imparting a quantity of electrostatic charges per unit time onto said photosensitive means, optical means for forming an optical image of said original document on said photosensitive means and toner application means for applying a quantity of electrostatic toner per unit time onto said photosensitive means, said improvement comprising:

user selectable switch means for selecting said electrophotographic apparatus to copy in at least two modes without substantially affecting the copy scaling, said modes being a standard mode and a draft mode;

speed control means responsive to said user selectable switch means in said standard mode for controlling said scanning speed of said movable scanning means at a first speed S1, for controlling said imaging speed of said movable photosensitive means at a first speed P1, and for controlling said toner application means for applying a first quantity of said electrostatic toner per unit time; and said speed control means further responsive to said user selectable switch means in said draft mode for controlling said scanning speed of said movable scanning means at a second speed S2 greater than said first speed S1, for controlling said imaging speed of said movable photosensitive means at a second speed P2 greater than said first speed P1, and for controlling said toner application means for applying said first quantity of said electrostatic toner per unit time.

2. An improvement in an electrophotographic apparatus capable of copying an original document in a copying operation, said apparatus comprising movable scanning means for scanning said original document at a scanning speed, movable photosensitive means for forming a latent electrostatic image at an imaging speed, electrostatic discharge means for imparting a quantity of electrostatic charges per unit time onto said photosensitive means, optical means for forming an optical image of said original document on said photosensitive means and toner application means for applying a quantity of electrostatic toner per unit time onto said photosensitive means, said improvement comprising:

user selectable switch means for selecting said electrophotographic apparatus to copy in at least two modes without substantially affecting the copy scaling, said modes being a standard mode and a draft mode;

speed control means responsive to said user selectable switch means in said standard mode for controlling said scanning speed of said movable scanning means at a first speed S1, for controlling said imaging speed of said movable photosensitive means at a first speed P1, and for controlling said electrostatic discharge means for imparting a first quantity of said electrostatic charges per unit time; and said speed control means further responsive to said user selectable switch means in said draft mode for controlling said scanning speed of said movable scanning means at a second speed S2 greater than said first speed S1, for controlling said imaging speed of said movable photosensitive means at a second speed P2 greater than said first speed P1, and for controlling said electrostatic discharge means for imparting said first quantity of said electrostatic charges per unit time.

3. The improvement in an electrophotographic apparatus as specified in claim 1 or 2, said improvement further comprising visual indicating means, responsive to said user selectable switch means, for indicating when said electrophotographic apparatus has been selected to copy in said draft mode.

4. The improvement in an electrophotographic apparatus as specified in claim 1 or 2, wherein said user selectable switch means selects said mode and a plurality of draft modes, and said speed control means is responsive to said user selectable switch means in any one of said plurality of draft modes.

5. The improvement in an electrophotographic apparatus as specified in claim 4, wherein said speed control means is responsive to said user selectable switch means prior to commencement of said copying operation of said electrophotographic apparatus.

6. The improvement in an electrophotographic apparatus as specified in claim 4, wherein said speed control means is responsive to said user selectable switch means during said copying operation of said electrophotographic apparatus.

7. An electrophotographic apparatus capable of copying an original document, said apparatus comprising:

movable scanning means moving at a speed S for scanning said original document;

movable photosensitive means moving at a speed P for forming a latent electrostatic image;

electrostatic discharge means for imparting a quantity of electrostatic charges per unit time onto said photosensitive means;

optical means for forming an optical image of said scanned original document on said photosensitive means;

toner application means for applying a quantity of electrostatic toner per unit time onto said photosensitive means;

copy speed control means for selectably varying said speeds S and P such that more of said copies may be produced per unit time; and toner application control means for selectably varying said quantity of applied electrostatic toner per unit time independently from and during said variations in said speeds S and P.

8. An electrophotographic apparatus as specified in claim 7, wherein said electrostatic discharge means imparts a substantially fixed quantity of electrostatic charges per unit time onto said photosensitive means during said variations in speeds S and P.

9. A copy speed control means as specified in claim 7, wherein said speeds S and P may be selectably varied prior to the actual copying operation of said electrophotographic apparatus.

10. A copy speed control means as specified in claim 7, wherein said speeds S and P may be selectably varied during the actual copying operation of said electrophotographic apparatus.

11. An electrophotographic apparatus as specified in claim 7, wherein said movable scanning means comprises an electrical lamp and a mirror slidably mounted within said electrophotographic apparatus.

12. An electrophotographic apparatus as specified in claim 7, wherein said movable photosensitive means comprises a substantially cylindrical drum having a photosensitive outer surface.

13. An electrophotographic apparatus as specified in claims 7 or 8, wherein said electrostatic discharge means comprises an electrode with voltage applied thereto.

14. An electrophotographic apparatus as specified in claim 7, wherein said optical means comprises a plurality of mirrors having angles of incidence and reflection and providing a substantially direct optical path between said movable scanning means and said movable photosensitive means.

15. An electrophotographic apparatus as specified in claim 7, wherein said toner application 10 means comprises a container of electrostatic toner with an electromechanical applicator.

16. An electrophotographic apparatus as specified in claim 7, wherein said copy speed control means comprises an electrical apparatus having a plurality of selectable electrical output signals which control said speeds S and P.

17. An electrophotographic apparatus as specified in claim 16, wherein said selectable electrical output signals comprise electrical pulses having selectable duty cycles.

18. An electrophotographic apparatus as specified in claim 7, wherein said toner application control means comprises an electrical apparatus having selectable electrical output signals electrically coupled to said toner application means.

19. An electrophotographic document copier comprising:

a movable scanning member driven by a scanning motor having a selectably variable rotational speed SM;

a rotatable photosensitive drum driven by a drum motor having a selectably variable rotational speed PM;

an electrostatic generator having a fixed electrostatic charge output;

an electrostatic toner applicator having a toner application output; and a motor controller having electrical motor control signals electrically coupled to said scanning and drum motors to increase the copy rate while maintaining the same copy scaling.

20. An electrophotographic document copier as specified in claim 19, wherein said toner application output magnitude per unit time is fixed.

21. An electrophotographic document copier as specified in claim 19, wherein said motor control signals comprise electrical pulses having selectable duty cycles.

* * * * *